US007213491B1

(12) United States Patent
Thompson et al.

(10) Patent No.: US 7,213,491 B1
(45) Date of Patent: May 8, 2007

(54) RATCHETING TOOL

(75) Inventors: Christopher D. Thompson, Milwaukee, WI (US); Michael L. Foster, Kenosha, WI (US)

(73) Assignee: Snap-on Incorporated, Kenosha, WI (US)

( * ) Notice: Subject to any disclaimer, the term of this patent is extended or adjusted under 35 U.S.C. 154(b) by 159 days.

(21) Appl. No.: 10/893,598

(22) Filed: Jul. 16, 2004

(51) Int. Cl.
*B25B 13/00* (2006.01)
*B25B 13/46* (2006.01)

(52) U.S. Cl. ..... 81/58.3; 81/62; 81/63

(58) Field of Classification Search ..... 81/58.3, 81/62, 63.1, 63, 177.85
See application file for complete search history.

(56) References Cited

U.S. PATENT DOCUMENTS

| | | | | |
|---|---|---|---|---|
| 80,622 | A | 8/1868 | Goss | |
| 685,282 | A | 10/1901 | Johnson | |
| 1,627,441 | A | 5/1927 | Lawyer | |
| 2,292,228 | A | 8/1942 | Krieger | |
| 2,300,479 | A | 11/1942 | Wilson | |
| 3,175,434 | A * | 3/1965 | Bergquist | 81/58.2 |
| 3,827,470 | A | 8/1974 | Douglas et al. | |
| 3,931,872 | A | 1/1976 | Dissett | |
| 4,030,384 | A | 6/1977 | Newman | |
| 4,051,935 | A | 10/1977 | Nakayama | |
| 4,270,417 | A | 6/1981 | Tesoro | |
| 4,479,409 | A | 10/1984 | Antonius | |
| 4,491,043 | A | 1/1985 | Dempsey et al. | |
| 4,777,852 | A | 10/1988 | Herman et al. | |
| 4,848,779 | A * | 7/1989 | Wheeler et al. | 279/60 |
| 4,939,961 | A | 7/1990 | Lee | |
| 5,058,463 | A | 10/1991 | Wannop | |
| 5,388,479 | A | 2/1995 | Sroka | |
| 5,427,003 | A | 6/1995 | Boltak et al. | |
| 5,595,095 | A * | 1/1997 | Hillinger | 81/58.3 |
| 5,737,982 | A | 4/1998 | Lin | |
| 5,782,146 | A | 7/1998 | Lin | |
| 5,850,767 | A | 12/1998 | Newman | |
| 5,875,692 | A | 3/1999 | Lin | |
| 6,131,489 | A | 10/2000 | Yang | |
| 6,158,308 | A | 12/2000 | Huang | |
| 6,206,160 | B1 | 3/2001 | Chen | |
| 6,227,077 | B1 | 5/2001 | Chiang | |
| 6,253,645 | B1 | 7/2001 | Lin | |
| 6,305,248 | B1 | 10/2001 | Rowlay | |
| 6,339,977 | B1 | 1/2002 | Lee et al. | |
| 6,450,067 | B1 | 9/2002 | Liao | |
| 6,523,439 | B1 | 2/2003 | Huang | |
| 6,543,315 | B2 | 4/2003 | Huang | |
| 6,568,693 | B2 | 5/2003 | Glass | |

* cited by examiner

*Primary Examiner*—Lee D. Wilson
*Assistant Examiner*—Alvin J. Grant
(74) *Attorney, Agent, or Firm*—Seyfarth Shaw LLP

(57) ABSTRACT

A ratcheting tool having an axial pawl ratcheting mechanism is provided that may be used for a screwdriver or wrench and comprises a first gear including axial gear teeth on a first side providing for ratcheting in a first direction. A second bidirectional gear has axial teeth on both sides. The second gear is mounted to the first side of the first gear so that the first gear axial gear teeth engage the second gear axial gear teeth and provide an axial pawl ratchet assembly. A ratchet head is provided having an opening for receiving the axial pawl ratchet assembly therein in order to transfer torque between the ratchet head and the axial pawl ratchet assembly. An actuator is provided for adjusting the positioning of the axial pawl ratchet assembly between a first position and a second position.

44 Claims, 5 Drawing Sheets

RATCHETING TOOL

The present application relates to a ratcheting tool, and in particular, to an axial pawl mechanism used with a hand tool or power tool to provide for application of torque and ratcheting in order to tighten or loosen a fastener.

BACKGROUND

Radial pawl systems are known for ratcheting mechanisms. A gear having peripheral teeth is mounted within the head of a tool and a pawl, having an individual finger, is pivotally mounted at the periphery of the gear. The pawl is biased into engagement with one or two teeth of the gear and when the head is rotated in one direction, transmits head rotation to the gear and when the head is rotated in the opposite direction, allows the head to undergo ratcheting rotation relative to the gear. The pawl generally includes a spring to bias the pawl to the engaged position against the teeth of the gear. In other embodiments, a radial pawl is provided which is a generally semicircular shaped disc having pawls formed by top corners of the disc. For example, U.S. Pat. No. 6,109,141 provides a reversible pawl disc that pivots between a first position, allowing ratcheting rotation in a first direction, and a second position, allowing for ratcheting rotation in a second direction. Such ratcheting pawl mechanisms have one to four teeth of the pawl engageable with the gear. Therefore, there is much vibration applied to a few teeth. As well, when the pawl engages the gear, in order to prevent rotation, there is a great amount of pressure against the teeth of the pawl. Therefore, such ratchet mechanisms provide a great amount of wear on the pawl and the lifetime of such pawls is limited.

While some pawl mechanisms are known that have teeth extending axially from a face of a disc, such systems have been very limited in their use and are not adaptable for use in most hand tools or power tools. Axial gear teeth of some prior art mechanisms are not easily adapted for bidirectional use. For example, U.S. Pat. No. 4,479,409 discloses a hand wrench having a crescent-shaped head portion having axial teeth formed on both sides. In order to provide for bidirectional ratcheting, the head portion must be removed completely from the wrench, inverted, and replaced on the wrench in the inverted position to provide for ratcheting in the opposite direction. Such a device is cumbersome to use and allows for the possibility that the head portion may be lost or displaced from the wrench.

SUMMARY

The present application pertains to a ratcheting tool comprising a first gear including a peripheral engagement surface and axial gear teeth on a first side providing for ratcheting in a first direction, a second gear having axial gear teeth and disposed so that the first disc axial gear teeth are engageable with the second gear axial gear teeth to provide an axial pawl ratchet assembly. A drive member is provided having an opening having inner diameter surface and disposed for receiving the axial pawl ratchet assembly therein so that the peripheral engagement surface of the first disc engages the inner diameter surface of the drive member in order to transfer torque between the drive member and the axial pawl ratchet assembly and an axially movable reverse ring coupled to the axial pawl ratchet assembly for axially adjusting the position of at least one of the first and second gears between a first position and a second position. In the first position the first and second gears are in engagement so that the ratchet assembly will ratchet in a first direction and transmit torque in a second direction. In the second position the first and second gears are out of engagement. In an embodiment, the second gear may include a second side having axial gear teeth, and may further comprise a third gear having axial gear teeth, the third gear being mounted to the second side of the second gear so that the second gear axial gear teeth are engageable with the axial gear teeth of the third gear to provide for torque transmission in the first direction and ratcheting in the second direction.

In an embodiment, the drive member may receive a rod having a bit. In an embodiment, the axial pawl ratchet mechanism may further comprise a gear holder mounted within the drive member and the second gear is formed as one piece with the gear holder. In an embodiment, the reverse ring may encircle the second gear and actuate between the first and second positions.

In an embodiment, the axial gear teeth of the first and second gears may pass over one another to provide overrunning or ratcheting. In an embodiment, the drive member may be torqued and rotates the first disc via the peripheral radial gear teeth interconnected with the inner diameter teeth of the drive member. In an embodiment, the reverse ring may be mounted within the opening of the drive member and engage the reverse cap to provide an actuation mechanism to provide for adjusting of the axial position of the first and second gear within the opening between the first position and the second position. In an embodiment, the drive member may include an inner diameter engagement portion for engaging inner diameter teeth of a third gear.

In an embodiment, the first and second gears and the reverse ring may be assembled together to form the axial pawl ratchet assembly and the reverse ring provides for actuation of the first and second gears. In an embodiment, the axial pawl ratchet mechanism may further comprise a bias structure mounted to the drive member and resiliently biasing each of the first and third gear into engagement with the second gear. In an embodiment, the axial pawl ratchet mechanism may have torque transmitted from a bit holder via the first gear or the third gear through the second gear via a gear holder to the drive member.

In an embodiment, the axial pawl ratchet mechanism may further comprise a reverse cap having a slot for receiving a lug extending from the actuator so that upon rotation of the reverse cap the lug rides in the slot in order to adjust the axial position of the actuator. In an embodiment, the slot may be disposed on an inner wall of the reverse cap, the cap having a bore having an open end and a closed end and the slot extending between a first point adjacent the open end and a second point adjacent the closed end. In an embodiment, positioning of the lug at the first point may provide for the actuator to move the third gear out of engagement with the second gear to allow for the first gear to engage the second gear to provide ratcheting rotation in a first direction and torquing rotation in a second direction. In an embodiment, the positioning of the lug at the second point provides for the actuator to move the first gear out of engagement with the second gear to allow the third gear to engage the second gear to provide for torquing rotation in the first direction and ratcheting rotation in the second direction. In an embodiment, the slot may include a midpoint disposed generally between the first point and the second point. In an embodiment, positioning of the lug at the midpoint may provide for the actuator to be located in a neutral position that allows for the first gear and third gear to engage the second gear in order to lock the ratcheting axial pawl mechanism.

In an embodiment, the axial pawl ratchet mechanism may further comprise a pin mounted to the drive member and the reverse cap may include a recessed area for receiving the pin. In an embodiment, the recessed area may include three detents corresponding to the first point, second point and midpoint so that upon rotating of the reverse cap to locate the actuator lugs in the first point, second point or midpoint the pin will simultaneously be moved in alignment with a first detent, second detent or middle detent, respectively.

In an embodiment, the axial pawl ratchet mechanism may further comprise a detention slot formed in the wall of the reverse cap and a detention lug protruding from the drive member for engaging the detention slot in order to retain the reverse cap to the drive member. In an embodiment, the detention slot may include an entry portion formed at about a right angle to a positioning portion of the slot so that upon placement of the reverse cap onto the drive member the detention lug is received by the entry portion and the cap is freely movable axially while the detention lug is within the entry portion. In an embodiment, upon rotation of the reverse cap the detention lug may be moved to the positioning portion and causes the pin to be captured within the recessed area and the combination of the pin captured by the recessed area and the detention lug received in the positioning portion causes the reverse cap to be retained on the drive member. In an embodiment, the pin may be spring loaded so that capture of the pin within the recessed area may prevent separation of the reverse cap from the drive member and restrict rotation of the reverse cap to an operational range equal to the length of the recessed area.

In an embodiment, one of the detents may include a hole extending through the top of the reverse cap so that when the pin is aligned with the hole a release tool may be inserted through the hole to depress the pin allowing for rotation of the reverse cap beyond the operational range and the detention lug is moved to the entry portion of the detention slot and the reverse cap may be removed from the drive member. In an embodiment, the axial pawl ratchet mechanism may be provided in a first engagement position and the actuator may be adjusted radially so that the first gear and the second gear will ratchet only in a first direction and transmit torque in a second direction to the drive member. In an embodiment, the axial pawl ratchet mechanism may be oriented in a second engagement position and the first gear may be adjusted radially so that it shifts its position engaging the second gear so that the first and second gear will ratchet only in a second direction and transmit torque in the first direction to the drive member.

In a further embodiment, a hand tool is provided comprising a tool head including a bore having an inner diameter having teeth, first and second gears each having peripheral gear teeth and axial gear teeth; a ratchet disc having first and second sides, each having axial gear teeth and the ratchet disc being mounted between the first and second gears providing an axial pawl ratchet mechanism where the axial gear teeth of the first side of the ratchet disc engage the axial gear teeth of the first gear and the axial gear teeth of the second side of the ratchet disc engage the axial gear teeth of the second gear, and an actuator mounted in the ratchet head and coupled to the axial pawl ratchet mechanism in order to move the axial pawl ratchet mechanism between a first condition where the first gear will ratchet in a first direction and transmit torque in a second direction and a second condition where the second gear will ratchet in the second direction and transmit torque in the first direction. In an embodiment, the tool may further comprise a rod disposed within the ratchet head, the first and second gears mounted to the rod and the ratchet disc formed as one piece with the rod. In an embodiment, the actuator comprises a ring encircling the ratchet disc providing a ratchet disc assembly and the ring has a first diameter and each of the first and second gears have a second diameter and the first and second diameters are approximately equal. In an embodiment, the actuator includes a pair of lugs protruding from sides of the ring beyond the first diameter.

In an embodiment, the tool may further comprise a reverse cap mounted to the head and the lugs of the ring engage the reverse cap to provide for axial adjustment of the axial pawl ratchet mechanism within a bore of the head between the first position and the second position via adjustment to the reverse cap. In an embodiment, the reverse cap may include a channel for controlling axial movement of the actuator within the tool head, so that in the first position, the first gear will ratchet only in a first direction and transmit torque in the second direction to the drive member. In an embodiment, the tool may further comprise the reverse cap mounted over an end and enclosing the head member. In an embodiment, the reverse cap includes a self-retaining means having a plunger received in an aperture in the reverse cap.

In an additional embodiment, an axial pawl ratchet mechanism is provided comprising an axial pawl ratchet mechanism comprising a first gear having axial gear teeth providing for ratcheting in a first direction, a second gear having a first and second side, each of the sides having axial gear teeth and disposed so that the axial gear teeth of the first side are engageable with the axial gear teeth of the first gear, a third gear having axial gear teeth, the third gear being disposed so that the axial gear teeth of the second side are engaged with the axial gear teeth of the third gear and the first, second and third gears provide an axial pawl ratchet assembly and an actuator coupled to the axial pawl ratchet assembly for adjusting the axial positioning of the first and third gear between a first position and a second position. In the first position the second gear engages only the first gear for ratcheting in a first direction and transmitting torque in a second direction, and in the second position the second gear engages only the third gear for ratcheting in the second direction and transmitting torque in the first direction.

In an embodiment, a pair of springs may be mounted within the ratchet head that bias the first and third gears into engagement with the second gear. In an embodiment, the first and third gears may be caused to alternatingly engage the second gear via axial adjustment of the actuator. In an embodiment, a ratchet head for receiving the axial pawl ratchet assembly may be provided and wherein first and third gears are radially fixed within the ratchet head. In an embodiment, a gear holder may be disposed within the ratchet head, the gear holder having outer diameter gear teeth for receiving the second gear thereon. In an embodiment, radial gear teeth may be provided on an inner diameter of the second gear and wherein the gear holder transfers torque to the ratchet head via the radial gear teeth engaging the outer diameter gear teeth of the gear holder when the second gear is engaged in a torque transmitting position with the first or third gears. In an embodiment, the second disc may comprise a pawl disc. In an embodiment, the pawl disc may be formed integrally with the gear holder. In an embodiment, the pawl disc may be a separate disc mounted to the gear holder.

In still another embodiment a ratcheting tool is provided comprising a driver having an axis of rotation, a gear holder mounted to the driver, a bidirectional gear disposed on the gear holder, a reverse ring mounted adjacent to the bidirectional gear, the ring having a protruding lug, a pair of gear discs respectively disposed on opposite sides of the bidirectional gear and engageable with the reverse ring and a reverse cap having a slot for receiving the lug and the slot oriented to provide a travel path for the lug so that upon rotation of the reverse cap the reverse ring is adjusted along the axis in order to disengage one of the gear discs from engagement with the bidirectional gear. In an embodiment, the bidirectional gear may be formed as one piece with the gear holder. In an embodiment, the bidirectional gear may be formed as a disc having an open center that is mounted over the gear holder. In an embodiment, the reverse ring may include a pair of lugs. In an embodiment, each of the gear discs may include axial gear teeth and the bidirectional gear includes axial gear teeth on each side for engaging the axial gear teeth of each gear disc.

In an embodiment, the bidirectional gear may include a first side having axial gear teeth for providing ratcheting in a first direction and driving in a second direction and a second side having axial gear teeth for providing ratcheting in the second direction and driving in the first direction. In an embodiment, a first bias member may be biasing a first gear disc against the bidirectional gear in order to provide driving in the second direction. In an embodiment, a second bias member may be biasing a second gear disc against the bidirectional gear in order to provide driving in the first direction. In an embodiment, the slot may be formed in a sidewall of the reverse cap and the slot extends between a first and second engagement position wherein the first engagement position is adjacent an open end of the cap and the second engagement position is adjacent a closed end of the cap. In an embodiment, a detention mechanism may be provided by the reverse cap. In an embodiment, the detention mechanism may include a second slot formed in the reverse cap, the second slot for receiving a detention lug protruding from the driver. In an embodiment, the detention mechanism may include a pin protruding from the driver and engaging a recessed area formed in the reverse cap.

In an additional embodiment, a method of ratcheting a tool is provided comprising the steps of providing a tool having a bidirectional gear, an actuator and a first and second gear disc disposed on opposite sides of the bidirectional gear, axially moving the actuator to a first position so that it abuts against the first disc, disengaging the first disc from the bidirectional gear due to the actuator being oriented in the first position, biasing the second disc against the bidirectional gear so that it ratchets in a first direction and transmits torque in a second direction, axially moving the actuator to a second position so that it abuts against the second disc, disengaging the second disc from the bidirectional gear due to the actuator being oriented in the second position; and biasing the first disc against the bidirectional gear so that it ratchets in the second direction and transmits torque in the first direction.

In and embodiment the method may further comprise the steps of providing the actuator comprising a reverse ring having a lug and a reverse cap having a slot and for receiving the lug and rotating the reverse cap so that the lug of the reverse ring rides in the slot in order to axially move the reverse ring, corresponding to the movement of the lug, from the first position to the second position. In an embodiment, the method may further comprise the steps of providing at least a first and second detent in the reverse cap and a drive member having a pin, mounting the first, second and bidirectional gears to the drive member, mounting the reverse cap to the drive member so that the pin is received by the first detent and simultaneously the lug is oriented so that the reverse ring is in the first position and rotating the reverse cap so that the lug rides in the slot in order to move the reverse ring to the second position and the pin is received by the second detent.

BRIEF DESCRIPTION OF THE DRAWINGS

For the purpose of facilitating an understanding of the subject matter sought to be protected, there are illustrated in the accompanying drawings an embodiment thereof, from an inspection of which, when considered in connection with the following description, the subject matter sought to be protected, its construction and operation, and many of its advantages should be readily understood and appreciated.

DETAILED DESCRIPTION

Figure 1:
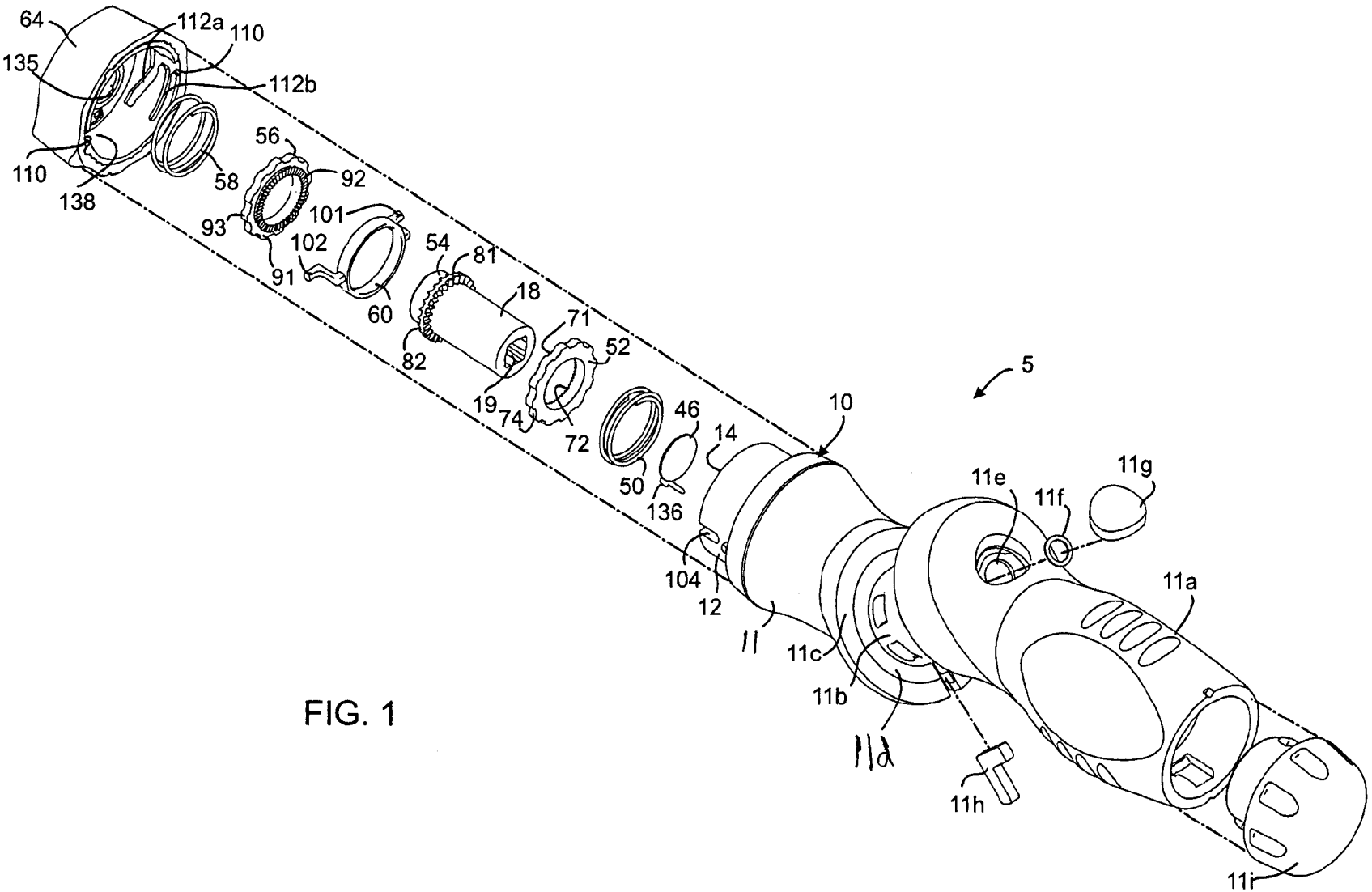
FIG. 1 is an exploded, perspective view of an embodiment of a ratcheting tool.

Referring to FIGS. 1–6, there are illustrated embodiments of a ratcheting tool 5. The tool 5 includes a ratchet head (drive member) or tool head 10. In an embodiment, the tool head 10 includes a body 11 and a cylindrical collar 12. In an embodiment, the body may be a handle or tool member. For example, as shown in FIG. 1, the body 11 may include a gripping member 11*a*. In an embodiment, the gripping member 11*a* may be pivotally mounted to the body 11. A neck 11*b* and shoulder 111*c* are formed at an end of the body 111 to provide a protruding bearing structure 11*d*. In an embodiment, the bearing structure 11*d* has a cylindrical shape that is received within a bore formed in the gripping member 11*a* to provide for pivoting or swivel movement of the gripping member 11*a* with respect to the body 11. In an embodiment, the body 11 may include a fastener aperture 11*e*, washer 11*f*, an enclosure cap 11*g* and slide stop 11*h*. In an embodiment, the slide stop 11*h* may be spring mounted within a slot formed in the bearing structure 11*d*. The gripping member 11*a* may also include an end cap 11*i*. However, it is to be understood that the body 11 of the head 10 may have a configuration other than depicted herein and may have other functions than depicted.

Figure 2:
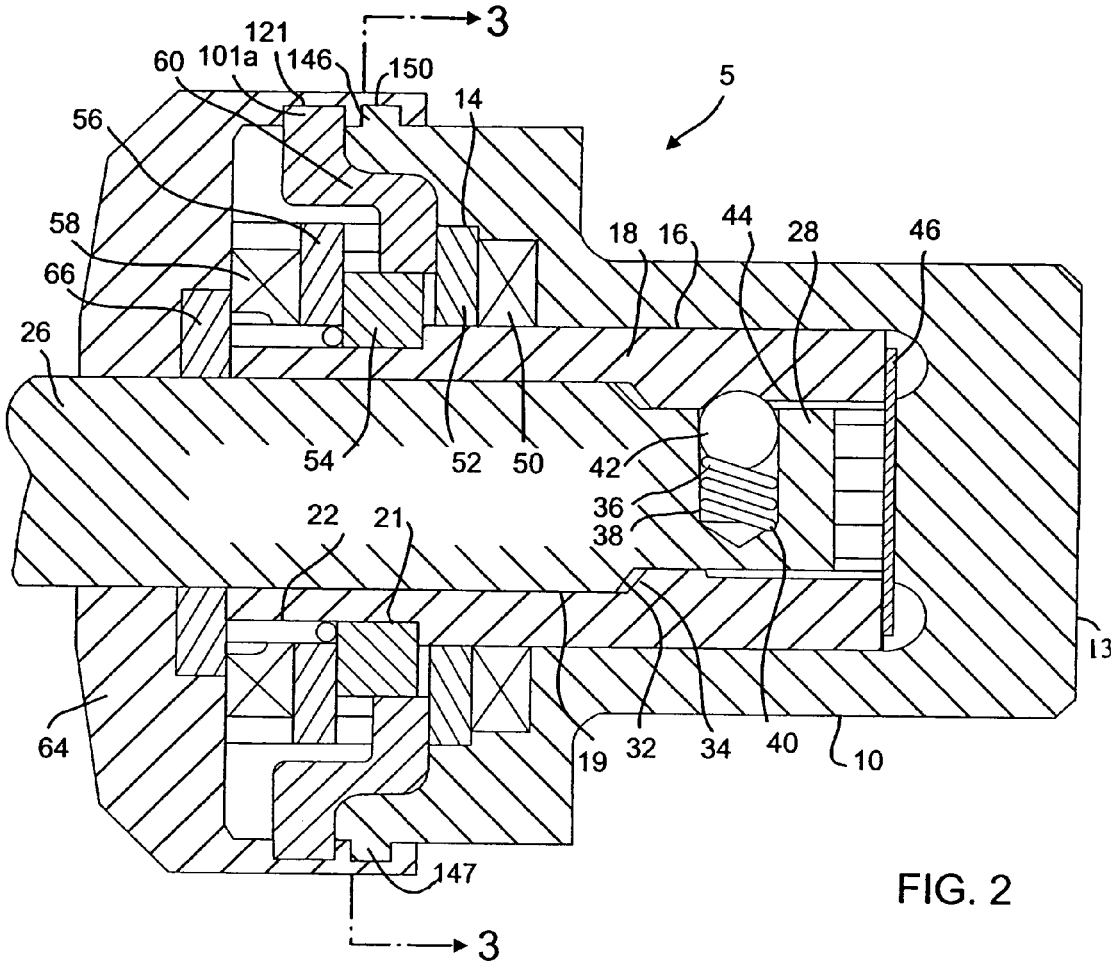
FIG. 2 is a fragmentary longitudinal sectional view of another embodiment of a ratcheting tool with a reverse ring in a first position.
Figure 3:
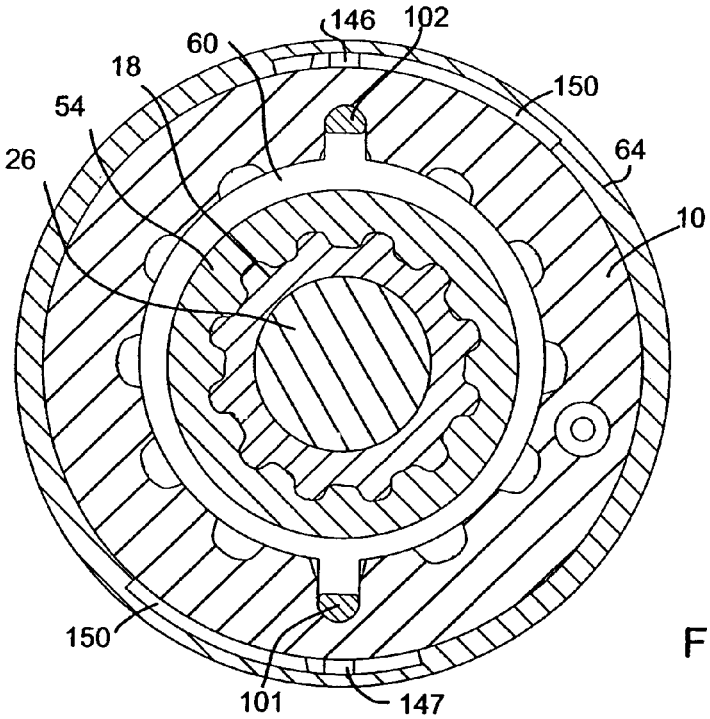
FIG. 3 is a sectional view taken along line 3—3 in FIG. 2.
Figure 4:
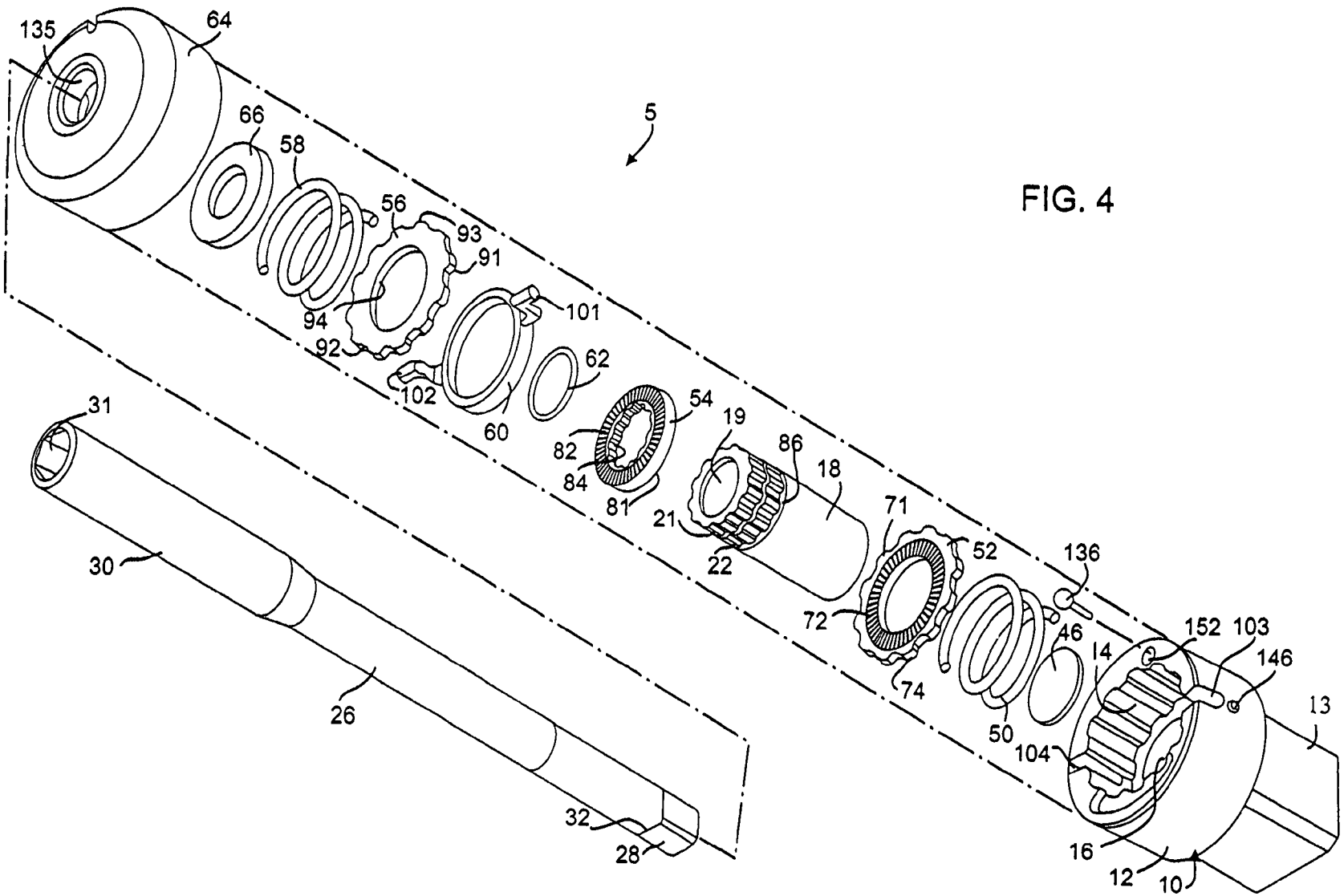
FIG. 4 is a reduced, exploded, perspective view of the tool of FIG. 2.

In another embodiment, as depicted in FIGS. 2–4, the body may have a square end 13. The square end 13 may be received by a tool member so that the tool 5 may be mounted or attached thereto. For any embodiment, regardless of the configuration of the body 11, the components depicted in FIGS. 1–6 may be included in order to provide for an axial pawl ratchet mechanism of the tool 5 and such components have the same numeral designators for the embodiments of FIG. 1 and FIGS. 2–6. The drive head 10 includes an opening 14 in communication with a bore 16. In an embodiment, the opening 14 has a geared surface. Mounted within the bore 16 is a gear holder 18 or rod having a cylindrical shape including an aperture 19. In an embodiment, the gear holder 18 includes a first row of outer diameter gear teeth 21 and a second row of outer diameter gear teeth 22 (FIGS. 2 and 4). A rod 26 including a mounting end 28 is mounted within the aperture 19 of the gear holder 18 (as shown in FIGS. 2–4). The rod 26 includes a drive handle 30 and a bit holder 31 (see FIG. 4). The rod 26 functions as a drive member having a bit such as a Phillips head or regular screw driver bit for turning a fastener in an embodiment, a square or hex or other shaped bit holder 31 may be provided. In an embodiment, the rod 26 may include a screwdriver blade or bit (not shown) to allow the tool 5 to work on a fastener. In an embodiment, the rod includes a chamfer 32 that corresponds to a ridge 34 of the gear holder 18 that restricts the rod 26 from being inserted too far into the aperture 19 of the gear holder.

In an embodiment, the rod 26 includes a retention assembly 36 mounted within a channel 38 formed within the mounting end 28 of the rod 26 (FIG. 2). In an embodiment, the retention assembly 36 includes a bias member 40 such as a spring and a ball 42. The ball 42 is received in a recessed area 44 formed within the aperture 19 of the gear holder 18. It may be understood that upon insertion of the rod 26 within the aperture 19, the ball 42 abuts against the ridge 34 which compresses the spring 40 and upon further insertion of the bit holder 28 of the rod 26, the ball 42 is received in the recessed area 44 which allows for the spring 40 to decompress. In its fully-mated position, the rod 26 is retained within the aperture 19 of the gear holder 18. Moderate force must be applied to the rod 26 in order to pull it out of the aperture 19. Such movement of the rod 26 causes the ball 42 to abut the ridge 34 so that the spring 40 is compressed and allows the bit holder end 28 to be removed from the aperture 19. A spacer 46 is mounted at the bottom of the bore 16 and helps to separate the end of the gear holder 18 from the bottom of the bore 16.

Mounted to the gear holder 28 are a first bias structure 50, a first gear 52, a second gear 54 and a third gear 56 which form an axial pawl ratchet assembly and mechanism. A second bias structure 58 and a reverse ring or actuator 60 are also mounted to the gear holder 18. In an embodiment, a retaining ring 62 may be used to retain the second gear 54 to the gear holder 18 (FIG. 4). Each of these components are mounted to the gear holder 18 and are retained within the drive member opening 14 by a reverse cap 64. In an embodiment, the reverse cap 64 may include a washer that surrounds the rod 26.

In an embodiment, the first gear 52 is formed as a disc or plate including a first side 71 having axial gear teeth 72 formed thereon. The first gear 52 also includes a peripheral engagement surface such as radial gear teeth 74. The radial gear teeth 74 are formed to be received by and correspond with the inner diameter surface, for example gear teeth formed in opening 14 of the drive member 10. In an embodiment, the first gear 52 may have outer or peripheral engagement features having a shape, such as a hex, corresponding to a shape of an interior engagement surface of the opening 14.

The second gear 54, in an embodiment, is a bidirectional ratchet disc having a first side 81 and a second side 82, each having axial gear teeth. The axial gear teeth on the first side 81 allow for rotation by abutting gear teeth in one direction and rotation in an opposite direction on the second side 82. In an embodiment, as shown in FIG. 1, the second gear 54 is mounted to the gear holder 18. In an embodiment, the second gear 54 is integrally formed with the gear holder 18. For example, the gear holder 18 and second gear 54 may be molded or formed as one piece.

In an embodiment, as shown in FIG. 4, the second gear 54 is separated from the gear holder 78 and includes an inner engagement surface such as radial gear teeth on its inner diameter 84. The inner diameter gear teeth 84 are shaped to correspond to the outer diameter gear teeth of the second row 22 of the gear holder 18. In an embodiment, a lip 86 is formed adjacent to the second row gear teeth 22 so that upon mounting of the second gear 54 to the gear holder 18, the inner diameter gear teeth 84 align with the outer diameter gear teeth 22. Thus, the second gear 54 cannot slide any further down on the gear holder 18 because it will abut the lip 86.

In an embodiment, the third gear 56 is formed identically to the first gear 52 and is a disc or plate having a first side 91 having axial gear teeth 92. In an embodiment, the third gear 56 includes peripheral gear teeth 93 or peripheral engagement features. The axial gear teeth 92 on the first side 91 correspond to the axial gear teeth of the second side 82 of the second gear 54. Likewise, the axial gear teeth on the first side 81 of the second gear 54 correspond with the axial gear teeth 72 on the first side 71 of the first gear 52. The axial gear teeth of the first gear 52 are shaped in order to provide for ratcheting when abutting the first side 81 when the second gear 54 is rotated in a first direction and transmission of the torque when the second gear 54 is rotated in a second direction. Conversely, the axial gear teeth 92 of the third disc 56 are oriented so that they provide ratcheting when abutting the axial gear teeth on the second side 82 of the second gear 54 as it is rotated in the second direction and provides for transmission of torque when the second gear 54 is rotated in a first direction. The axial pawl ratchet assembly is assembled so that ratcheting occurs only when either the first gear 52 is in engagement with the second gear 54 or the third gear 56 is in engagement with the second gear 54. The first gear 52 or third gear 56 are moved in and out of engagement with the second gear 54 via actuation by the reverse ring 60, as will be discussed in detail below.

The axial pawl ratchet assembly of the tool 5 provides for transfer of torque. Rotation of the rod 26 occurs by turning the head 10 and body 11 that will cause the gear holder 18 to rotate. The rod 26 includes a contoured end, such as the square-shaped mounting end 28, which is received in the correspondingly shaped aperture 19. Any rotation of the gear holder 26 is transferred to the rod 25. In an embodiment, the torque transferred through the gear holder 18 is also transferred simultaneously (with respect to the embodiment of FIG. 2, via the outer diameter gear teeth or engagement features 22 through the inner diameter gear teeth or engagement surface 84) to the second gear 54. Thus, for example, when the ratchet assembly is oriented appropriately, as discussed below, if the body 11 and head 10 are rotated in a counterclockwise direction, the first and third gear 52, 56 will also rotate in a counterclockwise direction via the gear teeth 14 of the opening of the drive member 10. Such counterclockwise motion will be transferred to the second gear 54 when it is oriented abutting the axial gear teeth 72, 92 of either the first or third gear 52, 56, respectively. In an embodiment, the axial gear teeth 72 of the first side 71 of the first gear 52 will transfer torque in the counterclockwise direction to the axial gear teeth 81 of the second gear 54. Upon rotation of the body 11 and head 10 in a clockwise direction, the first and third gear 52, 56 will also rotate clockwise. In an embodiment, when the ratchet assembly is oriented the same as above, ratcheting of the axial gear teeth 81 of the second gear 54 may occur against the axial gear teeth 72 of the first gear 52 and provide a retracting step for the tool 5.

Adjustment of the reverse cap 64, as will be explained in greater detail below, will cause the reverse ring 60 to move the first gear 52 out of engagement with the second gear 54 so that the third gear 56 is in engagement. Thus, for example, with the third gear 56 engaged, ratcheting may occur when the rod 26 is rotated counterclockwise and torque transfer may occur when the rod 26 is rotated clockwise. In an embodiment, the first row of outer diameter gear teeth 21 of the gear holder 18 may be smooth (FIG. 1). In an embodiment, the inner diameter surface of the third gear 56 forms a smooth bore 94. The bore 94 may either abut against the outer diameter gear teeth 21 of the gear holder 18 (FIG. 4) or in an alternate embodiment a smooth outer diameter surface of the gear holder 18 (FIG. 1).

Figure 6:
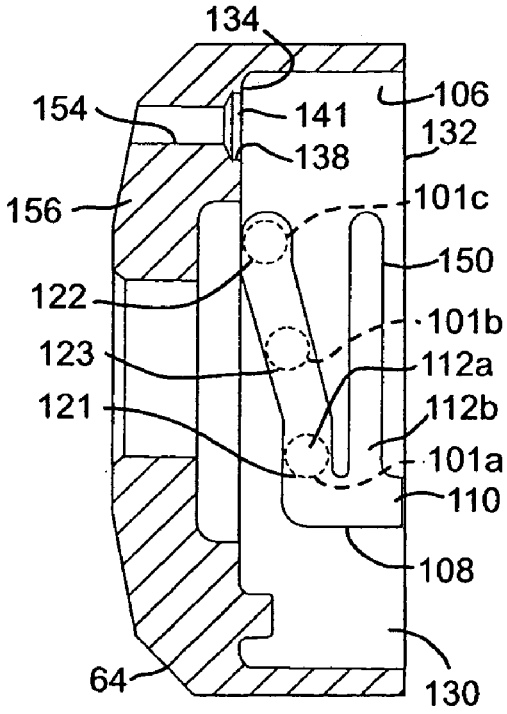
FIG. 6 is a sectional view taken along line 5—5 in FIG. 5.

The operation of the reverse ring 60 will now be described in more detail. The reverse ring 60 includes a first lug 101 and second lug 102. Each lug 101, 102 is received in a slot 103, 104 of the drive member 10. The lugs 101, 102 are formed so that they protrude beyond the slots 103, 104. In other words, the outer diameter of the collar 12 is less than the diameter of the ring taken across the lugs 101, 102. As shown in FIG. 6, the end cap 64 includes a wall 106 which has a cam or detention slot 108 formed therein. The detention slot 108 includes an entry portion 110 formed at approximately a right angle to positioning portions 112*a, b* of the slot. The positioning portion 112*a* of the slot is ramped or angled so that upon rotation of the reverse cap 64 the lug 101 *a, b, c* will ride in the slot between a first point or engagement position 121 and a second point or engagement position 122. A middle point or engagement position 123 is also provided. In an embodiment, slots 108 and entry portions 110 are formed on two sides of the side walls 106 of the reverse cap 64. The detention slots 108 on each side are formed correspondingly, so that each of the lugs 101, 102 will be moved simultaneously in a corresponding axial position in the slots 108. Upon rotation of the reverse cap 64, the lugs 101 *a, b, c,* 102 ride in the detention slots so that the reverse ring 60 is moved axially along the gear holder 18. The axial movement of the reverse ring 60 between the first and second positions 121, 122 causes the reverse ring to abut against either the first gear 52 or third gear 56 in order to move one or the other of the gears 52, 56 out of engagement with the second gear 54.

The reverse ring 60 is mounted so that it generally encircles the second gear 54. In the middle position 123 (FIG. 2A), the ring is generally coplanar with the second gear 54. Each of the first and third gears 52, 56 have smooth surfaces on their first sides 71, 91, respectively along their outer diameter portions adjacent to where the reverse ring 60 will abut. The smooth area of the first and third gears 52, 56 is at the periphery adjacent the axial gear area 72, 92, respectively. Thus, when the reverse cap 64 is rotated so that the lugs 101*a*, 102 and reverse ring 60 are in the first position 121, the reverse ring 60 abuts against the first gear 52 and holds it to the right (as shown in FIG. 2), so that the first gear 52 is not in engagement with the second gear 54. While the reverse ring 60 is moved to the first engagement position (to the right), the third gear 56 is biased by the spring 58 so that it is engaging the second gear 54. Thus, as discussed above, when the third gear 56 engages the second gear 54, ratcheting can occur in the second direction and transfer of torque in the first direction. In an embodiment, the bias members 50, 58 may be any type of biasing member such as a coil spring, flat spring, Belleville washer, elastomeric material or other biasing means.

Upon rotation of the reverse cap 64, the lugs 101, 102 will be moved from the first engagement position 121 to the second engagement position 122 by sliding the lugs up the angled positioning portion 112*a* of the detention slot 108. As the lugs 101, 102 are moved along the detention slot 108 to the middle position 123 (lug 10*b*; FIG. 6) and to the second position 122 (lug 101*c*; FIG. 6), the reverse ring 60 is moved to the left (as shown in FIG. 2) so that it engages the third gear 56 in order to move the third gear 56 out of engagement with the second gear 54 (see FIG. 2B). The first gear 52 will then be biased by the spring 50 in order to push it into engagement with the second gear 54. Thus, as discussed above, when the first gear 52 engages the second gear 54 ratcheting can occur in the first direction and transfer of torque in the second direction. Therefore, it may be understood that by rotation of the reverse cap 64, the reverse ring 60 is moved between the first position 121 (FIG. 2) and the second position 122 (FIG. 2B) so that the ratcheting and torquing operations of the tool 5 may be reversed.

Figure 2A:
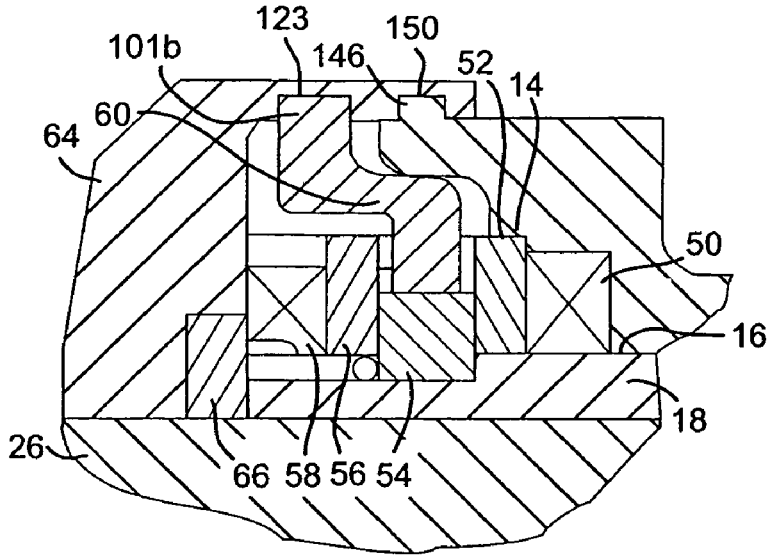
FIG. 2A is an enlarged fragmentary view of the tool of FIG. 2 depicting the reverse ring in a middle position.
Figure 2B:
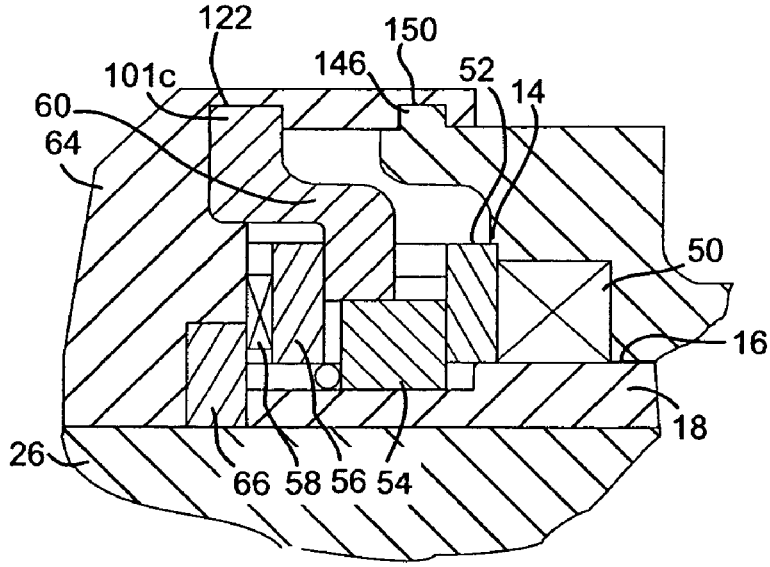
FIG. 2B is an enlarged fragmentary view of the tool of FIG. 2 depicting the reverse ring in a second position.

As well, the reverse cap 64 has a middle position 123. When the lugs 101, 102 and reverse ring 60 are oriented in the middle position 123, the ring 60 is not actuating either the first gear 52 or the third gear 56 and is generally coplanar with the second gear 54 (FIG. 2A). In this position, both the first gear and third gear 52, 56 are being biased by their springs 50, 56, respectively. Thus, both the first and third gears 52, 56 are engaging the second gear 54 which causes the tool 50 to be in a locked position so that no ratcheting will occur. In an embodiment, the tool 5 may include markings on its outer surface to identify whether it is in the first, middle or second position. Thus, it may be understood that the reverse cap 64 and reverse ring 60, in an embodiment, act in combination to provide an actuation mechanism to adjust the axial position of the first and third gears 52, 56.

Figure 5:
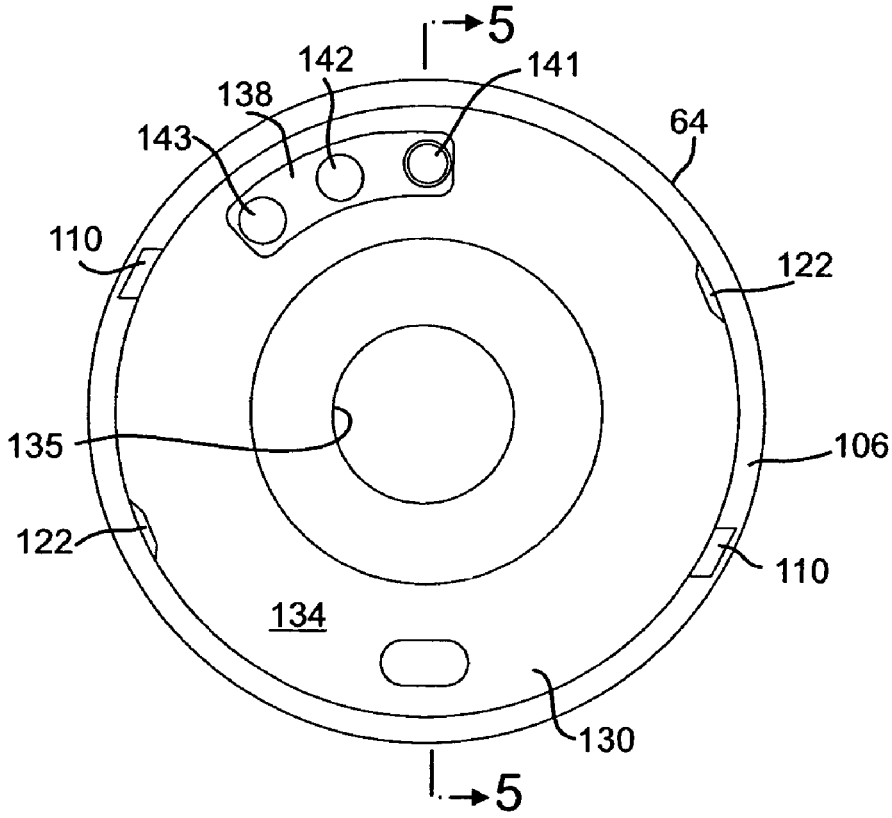
FIG. 5 is a reduced plan view of a cap of the tool FIG. 2.

The additional functioning of the reverse cap 64 will be described with respect to FIGS. 5 and 6. The reverse cap 64 includes the wall 106 forming a cylinder having a bore 130. The bore 130 has an open end 132 and a closed end 134. The slot 108 includes an entry portion 110 that extends between the open end 132 and the closed end 134 including the first position area 121 and the second position area 122. The reverse cap 64 includes a hole 135 for receiving the rod therethrough.

The tool assembly 5 may include a pin 136 mounted to the drive member 10 (see FIG. 4). The reverse cap 64 may include a recessed area 138 for receiving the head of the pin 136. The recessed area 138 may include three detents 141, 142, 143 corresponding to the first position 121, middle position 123 and second position 122, respectively. Rotating of the reverse cap 64 will locate the actuator lug 101*a*, 101*b*, 101*c* (shown in phantom in FIG. 6) in the first position or ratcheting point 121, middle position 123 or second position or ratcheting point 122. The pin head 136 will simultaneously be moved in alignment with the first detent 141, middle detent 142, or second detent 143. The tool assembly 5 may further comprise detention lugs 146, 147 protruding from the collar 12 of the drive member 10 for engaging a second detention slot 150 in order to retain the reverse cap 46 to the drive member 10. The second detention slot 150 may communicate with the entry portion 110 formed at about a right angle to the positioning portion 112*b* of the slot 108. Upon placement of the reverse cap 64 onto the drive member 10 the detention lugs 146, 147 are received at the entry portion 110 so that the cap 64 is freely movable axially while the detention lug 110 is within the entry portion 110. Simultaneously, the lugs 101, 102, are also received within the entry portion 110 of the detention slot 108 adjacent positioning portion 112*a*.

Upon rotation of the reverse cap 64, the detention lugs 146, 147 may be moved to positioning portions 112*a*, 112*b*. Mounting of the cap 64 onto the drive member 10 causes the pin to be captured within the recessed area 138. The combination of the pin 136 captured by the recessed area 138 and the detention lugs 146, 147 received in the positioning portions 112*a*, 112*b* causes the reverse cap 64 to be retained on the drive member 10. The pin 136 may be spring loaded within a void 152 (see FIG. 4) so that upon capture of the pin 136 within the recessed area 138 the spring biases the pin 136 outward so that the head of the pin 136 may abut edges of the recessed area 138 and restrict rotation of the reverse cap 64 to an operational range equal to the length of the recessed area 138. Thus, in an embodiment, the pin 136, recessed area 138 and detents 141, 142, 143 comprise a first detention mechanism and lugs 101, 102, 146, 147 and slots 108, 150 comprise a second detention mechanism. In an embodiment, the first and second detention mechanisms are combined on the reverse cap 64 and tool assembly 5 in order to detain and retain the reverse cap 64 on the drive member 10 and provide for actuation of the reverse ring 60 and provide demarcations for the first, middle and second positions of the tool assembly 5.

One of the detents 141 may include a hole 154 extending through the top 156 of the reverse cap 64. When the pin head 136 is aligned with the hole 154, a release tool may be inserted through the hole to depress the pin 136. Depression of the pin 136 allows for rotation of the reverse cap 64 beyond the operational range so that the detention lugs 146, 147 may be moved to the entry portion 110 of the detention slot 108 and the reverse cap 64 may be removed from the drive member 10. Therefore, it may be understood that while the lugs 101, 102, 146, 147 are actuated by the rotation of the reverse cap 64 between the first 121, middle 123 and second positions 122; the actuator 60 is simultaneously adjusted axially between first position (FIG. 2; lug 101*a*: FIG. 6), middle position (FIG. 2A; lug 101*b*: FIG. 6) and second position (FIG. 2B; lug 101*c*: FIG. 6) so that the first, second and third gears 52, 54, 56 can operate to ratchet in a first direction and transmit torque in a second direction to the drive member 10, or ratchet in a second direction and transmit torque in the first direction to the drive member 10.

In an embodiment, the tool 5 may be assembled by mounting the pin 136 into void 152 of the head 10. The second gear 54 (if necessary) is mounted to the gear holder 18 and the reverse ring is mounted around the second gear 54. First and third gears 52, 56 are mounted on both sides of the second gear 54 on the gear holder 18. Bias structures 50, 58 are then mounted on both sides of the gears 52, 56 on the gear holder 18 to provide an axial pawl ratchet assembly. A spacer 46 is placed within the bore 16 of the head 10. The axial pawl ratchet assembly is then mounted within the bore 16 of the head. In an embodiment, polarizing means may be provided in order to provide for the orienting of the gears in a particular orientation within the bore 16. For example, one of the external gear teeth 74 of the first gear 52 may have a larger width than the rest of the gear teeth 74 and corresponds to a larger width opening of the associated gear teeth 16 of the head 10. In an embodiment, the third gear 56 may have a similar polarizing means. If needed a washer 66 may be placed within the reverse cap 64. The reverse cap 64 is then mounted to the head 10 in order to retain the axial pawl ratchet assembly therein. Finally, the rod 26 is inserted within the hole 135 and through the aperture 19 of the gear holder 18. In an embodiment, assembly of the body 11 may also be necessary. For example, the gripping member 11*a* and each of its components (11*b*–*i*) may be assembled to attach it to the body 11. Operation of the tool 5 may proceed as describe above in order to provide for torquing and ratcheting as desired.

While particular embodiments have been shown and described, it will be apparent to those skilled in the art that changes and modifications may be made without departing from the principles of the ratcheting tool in its broader aspects. The matters set forth in the foregoing description and accompanying drawings is offered by way of illustration only and not as a limitation.

What is claimed is:

1. A ratcheting tool comprising:

a first gear including a peripheral engagement surface and axial gear teeth on a first side;

a second gear having axial gear teeth and disposed so that the first gear axial gear teeth are engageable with the second gear axial gear teeth to provide a ratchet disc assembly;

a drive member having an opening having an inner diameter surface disposed for receiving the ratchet disc assembly therein so that the peripheral engagement surface of the first gear engages the inner diameter surface of the drive member in order to transfer torque between the drive member and the ratchet disc assembly; and an axially movable reverse ring coupled to the ratchet disc assembly for axially adjusting the position of at least one of the first and second gears between a first position and a second position, in the first position the first and second gears being in engagement so that the ratchet assembly will ratchet in a first direction and transmit torque in a second direction, and in the second position the first and second gears being out of engagement.

2. The ratchet disc mechanism of claim 1 wherein the second gear includes a second side having axial gear teeth and further comprising a third gear having axial gear teeth, the third gear being mounted to the second side of the second gear so that the second gear axial gear teeth are engageable with the axial gear teeth of the third gear to provide for torque transmission in the first direction and ratcheting in the second direction.

3. The ratchet disc mechanism of claim 2 wherein the drive member receives a rod having a bit.

4. The ratchet disc mechanism of claim 3 further comprising a reverse cap mounted to the drive body and wherein the reverse ring is mounted within the opening of the drive member and engaging the reverse cap to provide an actuation mechanism to provide for adjusting of the axial position of the first and third gear within the opening between the first position and the second position.

5. The ratchet disc mechanism of claim 3 wherein the drive member includes an inner diameter engagement portion for engaging inner diameter teeth of the third gear.

6. The ratchet disc mechanism of claim 3 further comprising bias structure mounted to the drive member and resiliently biasing each of the first and third gears into engagement with the second gear.

7. The ratchet disc mechanism of claim 3 further comprising a reverse cap having a cam slot for receiving a lug extending from the actuator so that upon rotation of the reverse cap the lug rides in the slot in order to adjust the axial position of the reverse ring.

8. The ratchet disc mechanism of claim 7 wherein the slot is disposed on an inner wall of the reverse cap, the cap having a bore having an open end and a closed end and the slot extending between a first point adjacent the open end and a second point adjacent the closed end.

9. The ratchet disc mechanism of claim 8 wherein positioning of the lug at a first ratcheting point provides for the actuator to move the third gear out of engagement with the second gear to allow for the first gear to engage the second gear to provide ratcheting rotation in a first direction and torquing rotation in a second direction.

10. The ratchet disc mechanism of claim 9 wherein positioning of the lug at a second ratcheting point provides for the reverse ring to move the first gear out of engagement with the second gear to allow the third gear to engage the second gear to provide for torquing rotation in the first direction and ratcheting rotation in the second direction.

11. The ratchet disc mechanism of claim 7 wherein the slot includes a midpoint disposed generally between the first point and the second point, so that positioning of the lug at the midpoint provides for the reverse ring to be located in a neutral position that allows for the first gear and third gear to engage the second gear in order to lock the ratcheting axial pawl mechanism in a non-ratcheting condition.

12. The ratchet disc mechanism of claim 11 further comprising a pin mounted to the drive member, the reverse cap including a recessed area for receiving the pin.

13. The ratchet disc mechanism of claim 12 wherein the recessed area includes three detents corresponding to the first point, second point and a midpoint so that upon rotating of the reverse cap to locate the actuator lugs in the first point, second point or midpoint; the pin will simultaneously be moved in alignment with a first detent, second detent or middle detent, respectively.

14. The ratchet disc mechanism of claim 13 further comprising a detention slot formed in the wall of the reverse cap and a detention lug protruding from the drive member for engaging the detention slot in order to limit rotational movement of the reverse cap.

15. The ratchet disc mechanism of claim 14 wherein the pin is spring loaded so that capture of the pin within the recessed area will prevent separation of the reverse cap from the drive member.

16. The ratchet disc mechanism of claim 14 wherein one of the detents includes a hole extending through a top of the reverse cap so that when the pin is aligned with the hole a release tool may be inserted through the hole to depress the pin allowing for rotation of the reverse cap beyond the operational range and the detention lug is moved to the entry portion of the detention slot and the reverse cap may be removed from the drive member.

17. The ratchet disc mechanism of claim 1 further comprising a gear holder mounted within the drive member and the second gear is formed as one piece with the gear holder.

18. The ratchet disc mechanism of claim 1 wherein the reverse ring encircles the second gear and actuates between the first and second positions.

19. A hand tool comprising:

a tool head including a bore having an inner diameter having an engagement surface;

first and second gears each having peripheral engagement features and axial gear teeth;

ratchet disc having first and second sides, each of the sides having axial gear teeth and the ratchet disc being mounted between the first and second gears providing an ratchet disc mechanism where the axial gear teeth of the first side of the ratchet disc engage the axial gear teeth of the first gear and the axial gear teeth of the second side of the ratchet disc engage the axial gear teeth of the second gear; and an actuator mounted in the ratchet head and coupled to the ratchet disc mechanism in order to actuate the ratchet disc mechanism between a first position where the second gear is disengaged from the ratchet disc and the first gear engages the ratchet disc and will ratchet in a first direction and transmit torque in a second direction via its engagement features engaging the engagement surface of the tool head and a second position where the first gear is disengaged from the ratchet disc and the second gear engages the ratchet disc and will ratchet in the second direction and transmit torque in the first direction via its engagement features engaging the engagement surface of the tool head.

20. The tool of claim 19 further comprising a rod disposed within the ratchet head, the first and second gears mounted to the rod and the ratchet disc is formed as one piece with the rod.

21. The tool of claim 19 wherein the actuator comprises a ring encircling the ratchet disc providing a ratchet disc assembly and the ring has a first diameter and each of the first and second gears has a second diameter and the first and second diameters are approximately equal.

22. The tool of claim 21 wherein the actuator includes a pair of lugs protruding from sides of the ring beyond the first diameter.

23. The tool of claim 21 further comprising a reverse cap mounted to the head and the lugs of the ring engage the reverse cap to provide for axial adjustment of the ratchet disc mechanism within a bore of the head between the first position and the second position via adjustment to the reverse cap.

24. The tool of claim 23 wherein the reverse cap includes a channel for controlling axial movement of the actuator within the tool head, so that in the first position, the first gear will ratchet only in a first direction and transmit torque in the second direction to the drive member.

25. The tool of claim 19 further comprising a reverse cap mounted over an end and enclosing the tool head.

26. The tool of claim 25 wherein the reverse cap includes a self-retaining means comprising a pin received in a recessed area of the reverse cap.

27. A ratchet disc mechanism comprising:

a first gear having axial gear teeth;

a second gear having first and second sides, each of the sides having axial gear teeth and disposed so that the axial gear teeth of the first side are engageable with the axial gear teeth of the first gear;

a third gear having axial gear teeth, the third gear being disposed so that the axial gear teeth of the second side are engageable with the axial gear teeth of the third gear and the first, second and third gears provide an ratchet disc assembly; and an actuator coupled to the ratchet disc assembly for adjusting the axial positioning of the first and third gears between a first position and a second position, so that in the first position the second gear engages only the first gear for ratcheting in a first direction and transmitting torque in a second direction, and in the second position, the second gear engages only the third gear for ratcheting in the second direction and transmitting torque in the first direction.

28. The ratchet disc mechanism of claim 27 further comprising a ratchet head for receiving the ratchet disc assembly and wherein a pair of springs are mounted within the ratchet head that bias the first and third gears into engagement with the second gear.

29. The ratchet disc mechanism of claim 28 further comprising a ratchet head for receiving the ratchet disc assembly and wherein the first and third gears are radially fixed within the ratchet head.

30. A ratcheting tool comprising:

a driver having an axis of rotation;

a gear holder mounted to the driver;

a bidirectional gear disposed on the gear holder;

a reverse ring mounted adjacent to the bidirectional gear, the ring having a protruding lug;

a pair of gear discs respectively disposed on opposite sides of the bidirectional gear and engageable with the reverse ring; and a reverse cap having a slot for receiving the lug and the slot oriented to provide a travel path for the lug so that upon rotation of the reverse cap the reverse ring is adjusted along the axis in order to disengage one of the gear discs from engagement with the bidirectional gear.

31. The ratcheting tool of claim 30 wherein the bidirectional gear is formed as one piece with the gear holder.

32. The ratcheting tool of claim 31 wherein the bidirectional gear is formed as a disc having an open center that is mounted over the gear holder.

33. The ratcheting tool of claim 31 wherein the reverse ring includes a pair of lugs.

34. The ratcheting tool of claim 30 wherein each of the gear discs includes axial gear teeth and the bidirectional gear includes axial gear teeth on each side for engaging the axial gear teeth of each gear disc.

35. The ratcheting tool of claim 30 wherein the bidirectional gear includes a first side having axial gear teeth for providing ratcheting in a first direction and driving in a second direction and a second side having axial gear teeth for providing ratcheting in the second direction and driving in the first direction.

36. The ratcheting tool of claim 35 further comprising a first bias member biasing a first gear disc against the bidirectional gear in order to provide driving in the second direction.

37. The ratcheting tool of claim 35 further comprising a second bias member biasing a second gear disc against the bidirectional gear in order to provide driving in the first direction.

38. The ratcheting tool of claim 35 wherein the slot is formed in a sidewall of the reverse cap and the slot extends between a first and second engagement position wherein the first engagement position is adjacent an open end of the cap and the second engagement position is adjacent a closed end of the cap.

39. The ratcheting tool of claim 38 further comprising a detention mechanism provided by the reverse cap.

40. The ratcheting tool of claim 39 wherein the detention mechanism includes a second slot formed in the reverse cap, the second slot for receiving a detention lug protruding from the driver.

41. The ratcheting tool of claim 39 wherein the detention mechanism includes a pin protruding from the driver and engaging a recessed area formed in the reverse cap.

42. A method of ratcheting a tool comprising the steps of:

providing a tool having a bidirectional gear, an actuator and a first and second gear disc disposed on opposite sides of the bidirectional gear;

axially moving the actuator to a first position so that it abuts against the first disc;

disengaging the first disc from the bidirectional gear due to the actuator being oriented in the first position;

biasing the second disc against the bidirectional gear so that it ratchets in a first direction and transmits torque in a second direction;

axially moving the actuator to a second position so that it abuts against the second disc;

disengaging the second disc from the bidirectional gear due to the actuator being oriented in the second position; and biasing the first disc against the bidirectional gear so that it ratchets in the second direction and transmits torque in the first direction.

43. The method of claim 42 further comprising the steps of:

providing the actuator comprising a reverse ring having a lug and a reverse cap having a slot and for receiving the lug; and rotating the reverse cap so that the lug of the reverse ring rides in the slot in order to axially move the reverse ring, corresponding to the movement of the lug, from the first position to the second position.

44. The method of claim 43 further comprising the steps of:

providing at least a first and second detent in the reverse cap and a drive member having a pin;

mounting the first, second and bidirectional gears to the drive member;

mounting the reverse cap to the drive member so that the pin is received by the first detent and simultaneously the lug is oriented so that the reverse ring is in the first position; and rotating the reverse cap so that the lug rides in the slot in order to move the reverse ring to the second position and the pin is received by the second detent.

* * * * *